US009992821B2

(12) United States Patent
Ye et al.

(10) Patent No.: US 9,992,821 B2
(45) Date of Patent: Jun. 5, 2018

(54) AUTOMATIC HEATING APPARATUS

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Xin Ye, Wuhan (CN); Chun-Sheng Chen, New Taipei (TW)

(73) Assignees: HONG FU JIN PRECISION INDUSTRY (WuHan) CO., LTD, Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 466 days.

(21) Appl. No.: 14/695,783

(22) Filed: Apr. 24, 2015

(65) Prior Publication Data

US 2016/0234880 A1 Aug. 11, 2016

(30) Foreign Application Priority Data

Feb. 9, 2015 (CN) ..... 2015 1 0065893

(51) Int. Cl.
*H05B 1/02* (2006.01)

(52) U.S. Cl.
CPC ..... *H05B 1/0227* (2013.01)

(58) Field of Classification Search
CPC .. H05B 1/0227; H05B 1/0272; H05B 1/0252; H05B 3/0071; H05H 2201/036
USPC ..... 219/494, 497, 499, 501, 209, 210
See application file for complete search history.

(56) References Cited

U.S. PATENT DOCUMENTS 3,548,156 A * 12/1970 Davey ..... G05D 23/1906 219/499
3,810,254 A * 5/1974 Utsumi ..... G01R 33/31 219/209
3,924,101 A * 12/1975 Beard ..... F24C 7/087 219/490
4,225,777 A * 9/1980 Schindler ..... G05D 23/1927 219/492
5,373,141 A * 12/1994 Ko ..... G03G 15/2003 219/481
7,145,111 B2 * 12/2006 Hori ..... G03G 15/2039 219/497
8,263,911 B2 * 9/2012 Yen ..... G06F 1/20 219/481

* cited by examiner

*Primary Examiner* — Mark Paschall
(74) *Attorney, Agent, or Firm* — ScienBiziP, P.C.

(57) ABSTRACT

A heating apparatus includes a power source, a heating unit, and a control unit. The control unit includes a transistor and a thermal resistor. The transistor is connected between the power source and the heating unit to control the power source to provide power to the heating unit. The thermal resistor is connected to the transistor. A resistance value of the thermal resistor changes along with ambient temperature to turn on or off the transistor to control the power source to provide power to the heating unit according the ambient temperature.

14 Claims, 2 Drawing Sheets

AUTOMATIC HEATING APPARATUS

CROSS-REFERENCE TO RELATED APPLICATION

This application claims priority to Chinese Patent Application No. 201510065893.2 filed on Feb. 9, 2015, the contents of which are incorporated by reference herein.

FIELD

The subject matter herein generally relates to heating apparatus, and particularly to an automatic heating apparatus for warming in cold environment.

BACKGROUND

In winter, people's hands need to be protected from the cold. People often put on a pair of gloves to keep warm. However, the hands often need to be used to do work, and it is inconvenient to take the gloves on and off. Thus, a plurality of heating apparatus are provided to warm the hands. One kind of heating apparatus used widely is powered by electrical energy. However, if electrical energy is continually provided to the heating apparatus, the heating apparatus becomes very hot, which is dangerous. Thus, there is room for improvement in the art.

BRIEF DESCRIPTION OF THE DRAWINGS

Implementations of the present technology will now be described, by way of example only, with reference to the attached figures.

DETAILED DESCRIPTION

Figure 1:
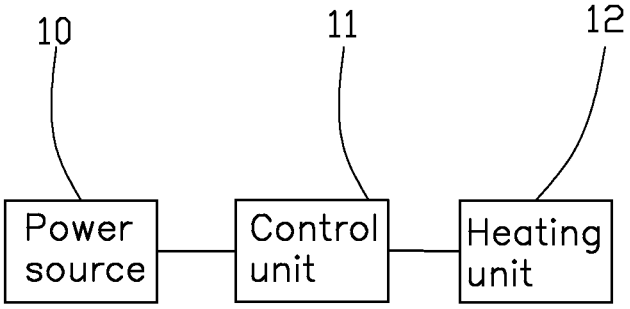
FIG. 1 is a block diagram of one embodiment of a heating apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

FIG. 1 illustrates one embodiment of a heating apparatus. The heating apparatus includes a power source 10, a control unit 11, and a heating unit 12. The control unit 11 is connected to the power source 10 and the heating unit 12. The control unit 11 controls the power source 10 to provide power to the heating unit 12.

Figure 2:
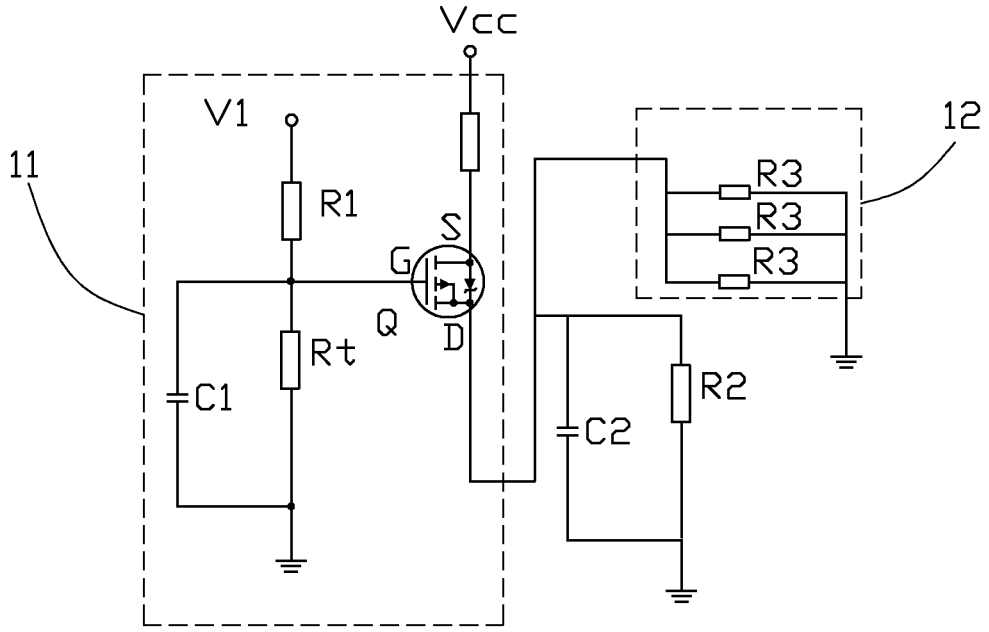
FIG. 2 is a circuit diagram of one embodiment of the heating apparatus of FIG. 1.

Referring to FIG. 2, the power source 10 provides a heating voltage Vcc. The control unit 11 includes a thermal resistor Rt, a divider resistor R1, a delay capacitor C1 and a transistor Q. A first end of the divider resistor R1 receives a control voltage V1. A second end of the divider resistor R1 is connected to a first end of the thermal resistor Rt. A second end of the thermal resistor Rt is connected to ground. A gate G of the transistor Q is connected to the second end of the divider resistor R1. The delay capacitor C1 is parallel connected with the thermal resistor Rt. A source S of the transistor Q receives the heating voltage Vcc. The drain D of the transistor Q is connected to the heating unit 12. A RC voltage regulator circuit, which includes a resistor R2 and a capacitor C2, is connected to the drain D to stabilize an output voltage on the drain D.

In the above control unit 11, the transistor Q is a N channel field effect tube. A resistance value of the thermal resistor Rt changes along with ambient temperature. Therefore, a threshold temperature can be set to turn on transistor Q by adjusting the resistance value of the divider resistor R1 and the control voltage V1. For example, when the temperature drops to 60 degrees celcius, a voltage on the gate G of the transistor Q is equal to a turning-on voltage of the transistor Q. Thus, when the temperature is lower than 60 degrees celcius, the transistor Q keeps on. When the temperature is higher than 60 degrees celcius, the transistor Q keeps off.

When the transistor Q is on, the heating voltage Vcc is supplied to the heating unit 12. In one embodiment, the heating unit 12 includes a plurality of heating resistors R3. When the transistor Q is off, the heating voltage Vcc is not supplied to the heating unit 12, and the heating unit 12 not works.

In use, when the ambient temperature is equal to or lower than the threshold temperature (such as 60 degrees celcius), the resistance value of the thermal resistor Rt is large, and the voltage on the gate G of the transistor Q is large enough to turn on the transistor Q. The heating unit 12 heats. When the ambient temperature is higher than the threshold temperature (such as 60 degrees celcius), the resistance value of the thermal resistor Rt is small, and the voltage on the gate G of the transistor Q is not large enough to turn on the transistor Q. The heating unit 12 not works. Therefore, it can avoid the heating unit 14 heating continually.

In the above embodiment, the divider resistor R1 can be a variable resistor. Therefore, a resistance value of the variable resistor varies to change the threshold temperature.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to, and including, the full extent established by the broad general meaning of the terms used in the claims. It will therefore be appreciated that the embodiments described above may be modified within the scope of the claims.

What is claimed is:

1. A heating apparatus comprising:

a power source;

a heating unit; and a control unit comprising a divider resistor, a transistor, and a thermal resistor, the transistor connected between the power source and the heating unit, the transistor configured to control the power source to provide power to the heating unit; wherein the power source provides a heating voltage, a first end of the divider resistor is connected to a control voltage, a second end of the divider resistor is connected to a first end of the thermal resistor, a second end of the thermal resistor is connected to ground;

wherein the thermal resistor is connected to the transistor;

wherein the thermal resistor is configured such that a resistance value of the thermal resistor changes in accordance with an ambient temperature of the heating apparatus; and wherein the thermal resistor is configured such that when the resistance values falls below a threshold, the transistor allows the heating unit to receive power from the power source.

2. The heating apparatus of claim 1, wherein a gate of the transistor is connected to the second end of the divider resistor, a source of the transistor receives the heating voltage, and a drain of the transistor is connected to the heating unit.

3. The heating apparatus of claim 2, wherein the resistance value of the thermal resistor becomes small when the ambient temperature rises, and the resistance value of the thermal resistor becomes large when the temperature drops.

4. The heating apparatus of claim 3, wherein the transistor is a N channel field effect tube, a voltage on the gate of the transistor rises to turn on the transistor when the resistance value of the thermal resistor rises, and the voltage on the gate of the transistor drops to turn off the transistor when the resistance value of the thermal resistor drops.

5. The heating apparatus of claim 2, wherein a RC voltage regulator circuit, which includes a resistor and a capacitor, is connected to the drain of the transistor to stabilize an output voltage on the drain.

6. The heating apparatus of claim 2, wherein a delay capacitor is parallel connected with the thermal resistor.

7. The heating apparatus of claim 1, wherein the heating unit comprises a plurality of heating resistors.

8. A fan control circuit comprising:

a power source providing a heating voltage;

a heating unit; and a control unit connected between the power source and the heating unit, the control unit configured to control to provide the heating voltage to the heating unit, the control unit comprising a thermal resistor and a divider resistor, wherein the power source provides a heating voltage, a first end of the divider resistor is connected to a control voltage, a second end of the divider resistor is connected to a first end of the thermal resistor, a second end of the thermal resistor is connected to ground; wherein the thermal resistor is configured such that a resistance value of the thermal resistor changes in accordance with an ambient temperature of the heating unit to provide the heating voltage to the heating unit.

9. The heating apparatus of claim 8, wherein the control unit comprises a transistor, a gate of the transistor is connected to the second end of the divider resistor, a source of the transistor receives the heating voltage, and a drain of the transistor is connected to the heating unit.

10. The heating apparatus of claim 9, wherein the resistance value of the thermal resistor becomes small when the ambient temperature rises, and the resistance value of the thermal resistor becomes large when the temperature drops.

11. The heating apparatus of claim 10, wherein the transistor is a N channel field effect tube, a voltage on the gate of the transistor rises to turn on the transistor when the resistance value of the thermal resistor rises, and the voltage on the gate of the transistor drops to turn off the transistor when the resistance value of the thermal resistor drops.

12. The heating apparatus of claim 9, wherein a RC voltage regulator circuit, which includes a resistor and a capacitor, is connected to the drain of the transistor to stabilize an output voltage on the drain.

13. The heating apparatus of claim 9, wherein a delay capacitor is parallel connected with the thermal resistor.

14. The heating apparatus of claim 8, wherein the heating unit comprises a plurality of heating resistors.

* * * * *